US005216226A

United States Patent [19]

Miyoshi

[11] Patent Number: 5,216,226

[45] Date of Patent: Jun. 1, 1993

[54] APPARATUS FOR PREVENTING AND PREDICTING DETERIORATION OF INSULATION IN AN ELECTRIC EQUIPMENT

[75] Inventor: Kazuo Miyoshi, Marugame, Japan

[73] Assignee: Mitsubishi Denki Kabushiki Kaisha, Tokyo, Japan

[21] Appl. No.: 845,022

[22] Filed: Mar. 3, 1992

[30] Foreign Application Priority Data

Mar. 4, 1991 [JP] Japan ..... 3-37050

[51] Int. Cl.[5] ..... H05B 1/02

[52] U.S. Cl. ..... 219/497; 219/494; 219/501; 73/335.05; 324/500; 340/650; 340/602

[58] Field of Search ..... 219/203, 494, 497, 501, 219/505, 508, 499; 73/336.5; 324/505, 500, 537, 555; 340/602, 650, 655

[56] References Cited

U.S. PATENT DOCUMENTS 4,127,763 11/1978 Roselli ..... 219/203
4,203,087 5/1980 Kovac et al. ..... 338/35
4,706,153 11/1987 Sainomoto et al. ..... 361/42

FOREIGN PATENT DOCUMENTS 61-184617 8/1986 Japan .
63-124118 5/1988 Japan .

*Primary Examiner*—Mark H. Paschall
*Attorney, Agent, or Firm*—Burns, Doane, Swecker & Mathis

[57] ABSTRACT

In an electrical equipment such as a control center, operation of space heaters is controlled on the basis of humidity detected by a humidity sensor plus a differential value of an effective value of leakage current flowing through insulating materials in the control center.

3 Claims, 14 Drawing Sheets

APPARATUS FOR PREVENTING AND PREDICTING DETERIORATION OF INSULATION IN AN ELECTRIC EQUIPMENT

FIELD OF THE INVENTION AND RELATED ART STATEMENT

1. Field of the Invention

The present invention relates to an apparatus for preventing and predicting deterioration of insulation in an electric equipment such as a control center.

2. Description of the Related Art

FIG. 13 is a perspective view showing the conventional control center 1. One upright panel 2 is composed of several feeder units 3 vertically mounted therein, and a necessary number of panels will be adjacently provided in the horizontal direction so that a necessary number of feeder units can be mounted therein. Each of the feeder units 3 is connected to a load such as a motor, and the motors are controlled by the respective feeder units 3. An operation handle 14 of a circuit breaker (mentioned later) is protruded from a door 2*a* of each of the feeder units 3, and an ornamental plate 40 including on/off indicating lamps 41 is mounted in the door 2*a*.

A pair of space heaters 4*a* and 4*b* are provided at the bottom of the panel 2. A humidity sensor 5, a dew-condensation sensor 6 and a temperature sensor 7 are provided at the upper part of the panel 2.

FIG. 14 is a block skeleton diagram showing a main (power) circuit per one panel 2 of the control center 1 shown in FIG. 13. FIG. 15 is a horizontal cross-sectional view showing one feeder unit 3 mounted in the panel 2. In FIG. 15, three bus-bars 8 are vertically held by plural insulating supporters 15 (only one pair of them are visible) in the panel 2. In FIGS. 14 and 15, by inserting the feeder unit 3 into the panel 2, three connectors 9 of the feeder unit 3 are connected with three bus-bars 8, respectively, thereby being supplied with electric power from the bus-bars 8. The feeder unit 3 is composed of a circuit breaker 11, a magnetic contactor 12 and a thermal relay 13. The circuit breaker 11 is connected to the connectors 9 via main circuit conductors 10. The magnetic contactor 12 and the thermal relay 13, which are generally coupled with each other, are connected in series with the circuit breaker 11. In FIG. 15, the circuit breaker 11 can be operated by the operation handle 14 after the door 2*a* for the feeder unit 3 has been closed.

FIG. 16 is a circuit diagram showing a control circuit of the space heaters 4*a* and 4*b*, and this circuit realizes an apparatus for preventing deterioration of insulation. Each of the space heaters 4*a* and 4*b* is supplied with electric power from a power-source line 16 by way of a circuit breaker 17. The space heaters 4*a* and 4*b* are connected in parallel with each other, and they are connected in series with a normally-open contact 18*a* which is actuated by a control relay 18. Output contacts 5*a* and 6*a* are connected in parallel with each other, and they are connected in series to an output contact 7*b* and the control relay 18. The output contact 5*a* is actuated by the humidity sensor 5 (FIG. 13), and the output contact 6*a* is actuated by the dew-condensation sensor 6 (FIG. 13). The output contact 7*b* is actuated by the temperature sensor 7 (FIG. 13).

Hereafter, operation of the above-mentioned feeder unit 3 (FIGS. 13–15) is described. After completion of insertion of the feeder unit 3 into the panel 2 as shown in FIG. 15, the operation handle 14 is operatable with the door 2*a* closed. When the operation handle 14 is operated to close the circuit breaker 11, the magnetic contactor 12 is impressed with a voltage at a primary end thereof. When a closing signal is given to the magnetic contactor 12, the magnetic contactor 12 is closed, and the load such as a motor connected to the feeder unit 3 is thereby driven. When an opening signal is given to the magnetic contactor 12, the magnetic contactor is opened, and the motor thereby stops. If a load current exceeds the predetermined level, the magnetic contactor 12 is automatically opened by means of operation of the thermal relay 13. When a short-circuit occurs in the load circuit, the circuit breaker 11 makes trip action, thereby interrupting the fault current.

Next, the conventional operation of the space heaters 4*a* and 4*b* is described. In the panel 2, a lot of insulating materials are used. For example, insulating supporter 15 (FIG. 15), insulating cases 9*a* (FIG. 15) and insulating materials constituting main circuit apparatuses and control circuit apparatuses are used in the panel 2. When the ambient humidity is high, each of these insulating materials absorbs moisture, and its insulation performance lowers. Thus, the insulating materials gradually deteriorate with lapse of time. Further, when dew condensation is made on a surface of each of the insulating materials, there occurs a tracking on the surface, and thereby the insulation performance deteriorates.

In order to prevent the above-mentioned deterioration of the insulating materials, the space heaters 4*a* and 4*b* are provided in each panel 2 of the control center 1.

In FIG. 13 and FIG. 16, the output contact 5*a* of the humidity sensor 5 is closed when the humidity is equal to or more than a predetermined value. The output contact 6*a* of the dew-condensation sensor 6 is closed when dew condensation is detected by the dew-condensation sensor 6. The output contact 7*b* of the temperature sensor 7 is opened when the temperature is equal to or higher than a predetermined value. Therefore, the control relay 18 is excited at the time when the following conditions are satisfied:

(1) the humidity is equal to or more than the predetermined value, or the dew condensation is detected; and (2) the temperature is less than the predetermined value.

When the control relay 18 is excited, the contact 18*a* is closed, thereby supplying the space heaters 4*a* and 4*b* with electric power. Heat generated by the space heaters 4*a* and 4*b* rises the temperature of air in the panel 2, and the relative humidity decreases accordingly. Deterioration of the insulating materials are thus prevented. When the temperature of air in the panel 2 reaches the predetermined value, the output contact 7*b* of the temperature sensor 7 is opened. The contact 18*a* of the control relay 18 is thereby opened, resulting in stoppage of power-supply to the space heaters 4*a* and 4*b*. Even in case where the temperature of air does not reach the predetermined value, both the output contacts 5*a* and 6*a* are opened when the dew condensation is lost owing to decrease of the humidity, and thereby power-supply to the space heaters 4*a* and 4*b* is stopped.

In the above-mentioned conventional apparatus for preventing deterioration of insulation in the electrical equipment such as the control center, the space heaters 4*a* and 4*b* are controlled by detecting the temperature of air, the humidity each in the panel 2 and the dew-condensation on the dew condensation sensor 6. That is, the control of the space heaters 4*a* and 4*b* is dependent on present conditions of air in the panel 2. In other words, these sensors do not actually detect the present conditions of the insulating materials themselves, but detect a specific condition of the air which may cause deterioration of the insulating materials. Besides, although each of the sensors 5,6 and 7 has a fixed set point, a relationship between the conditions (temperature, humidity) of air and the conditions (absorption of moisture, dew condensation on a surface) of the insulating materials is not always fixed. Accordingly, as a matter of fact, there are some cases that power-supply to the space heaters 4*a* and 4*b* stops before sufficient drying-up of the insulating materials. Thus, insulating performances of the insulating materials become worse as a result.

Further, since the conventional apparatus for preventing deterioration of insulation has no function for monitoring the insulating performances of the insulating materials, power-supply to the control center has to be temporarily suspended so that insulating resistance can be measured under a stoppage of electric power.

OBJECT AND SUMMARY OF THE INVENTION

An object of the present invention is to offer an apparatus for preventing and predicting deterioration of insulation in the electrical equipment, wherein the apparatus prevents deterioration of insulation in accordance with the actual condition of the insulating materials and predicts the deterioration of insulation without suspending operation of the electrical equipment.

In order to achieve the above-mentioned object, an apparatus of the present invention for preventing and predicting deterioration of insulation comprises:

a leakage current detector for detecting a leakage current flowing through insulating materials in the electrical equipment;

a sensor for detecting humidity in the electrical equipment;

a space heater mounted in the electrical equipment;

control means for controlling operation of the space heater in response to a first output signal based on the sensor and a differential value of an effective value of a second output signal based on the leakage current detector;

leakage-current measuring means which receives the second output signal and issues an effective value of the second output signal and a differential value of the effective value;

arithmetic judging means for issuing an output signal based on a result which is obtained by comparing the effective value and the differential value with respective predetermined value;

indicating means for indicating a state of insulating performance of the insulating materials in response to the output signal of the arithmetic judging means.

According to the present invention, deterioration of the insulating materials is prevented in the most suitable way that matches with the actual conditions of the insulating materials. Further, the insulating performance of the insulating materials can be monitored during the operation of the electrical equipment. Therefore, it is possible to save labor for maintenance and to take precautions against possible accidents of the electrical equipment.

While the novel features of the invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENT

Hereafter, a preferred embodiment of the present invention is described with reference to the accompanying drawings.

Figure 1:
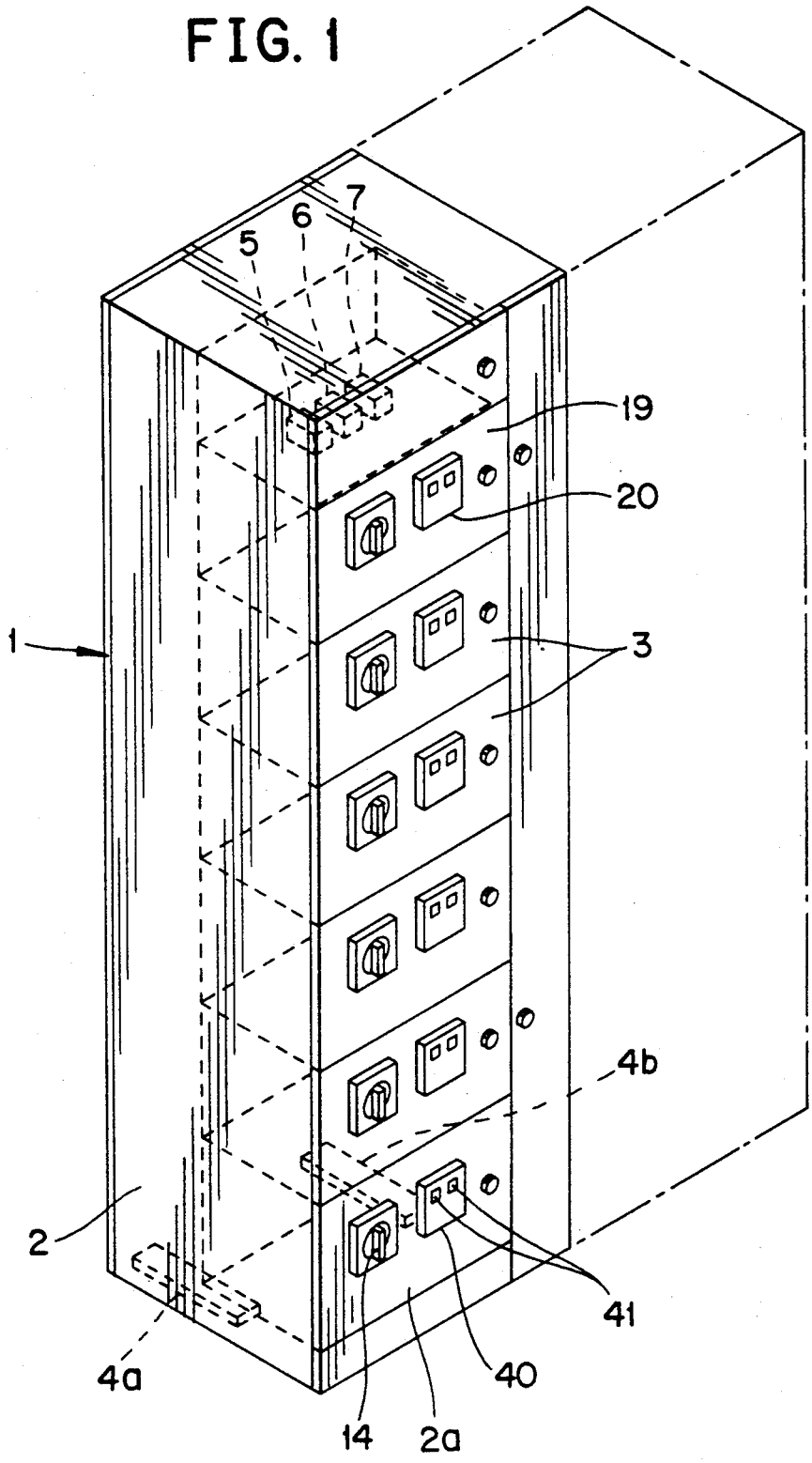
FIG. 1 is a perspective view showing a control center 1 to which the present invention is applied.

FIG. 1 is a perspective view showing a control center 1. One upright panel 2 is composed of several feeder units 3 and one leakage-current detecting unit 19, and these units are mounted vertically therein. A necessary number of panels will be adjacently provided in the horizontal direction so that a necessary number of feeder units can be mounted therein. Each of the feeder units 3 is connected to a load such as a motor, and the motors are controlled by the respective feeder units 3. An operation handle 14 of a circuit breaker (mentioned later) is protruded from a door 2*a* of each of the feeder units 3, and an ornamental plate 40 including on/off indicating lamps 41 is mounted in the door 2*a*.

A pair of space heaters 4*a* and 4*b* are provided at the bottom of the panel 2. A humidity sensor 5, a dew-condensation sensor 6 and a temperature sensor 7 are provided at the upper part of the panel 2. Each of the humidity sensor 5 and the temperature sensor 7 is of analogue-output type sensor.

Figure 2:
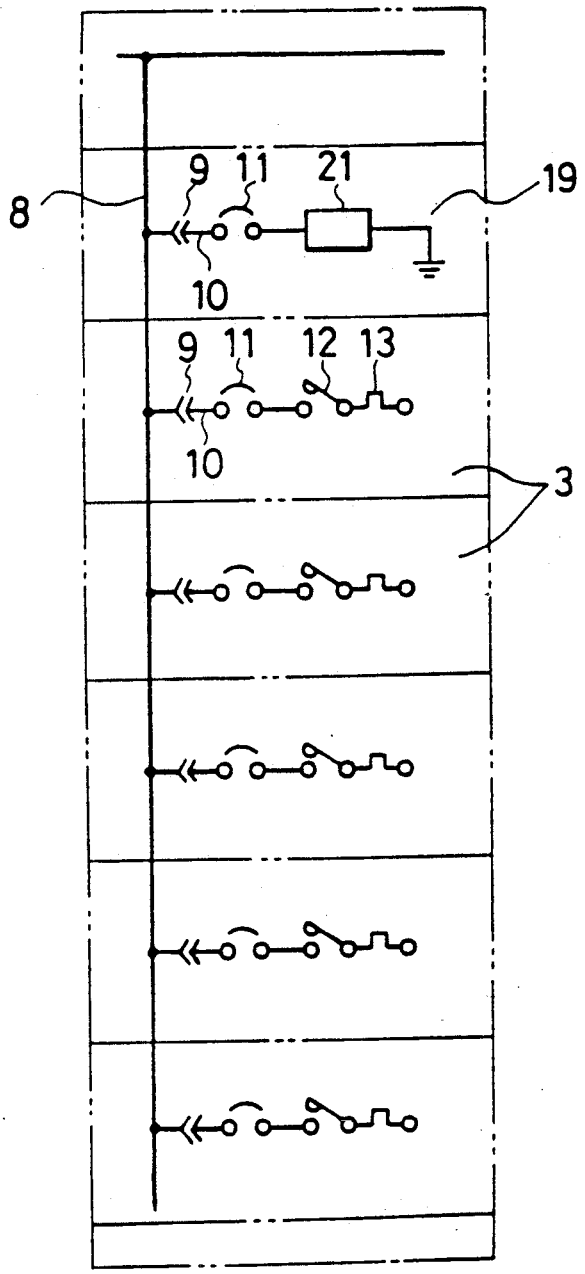
FIG. 2 is a block skeleton diagram showing main circuits of the control center 1 shown in FIG. 1.
Figure 15:
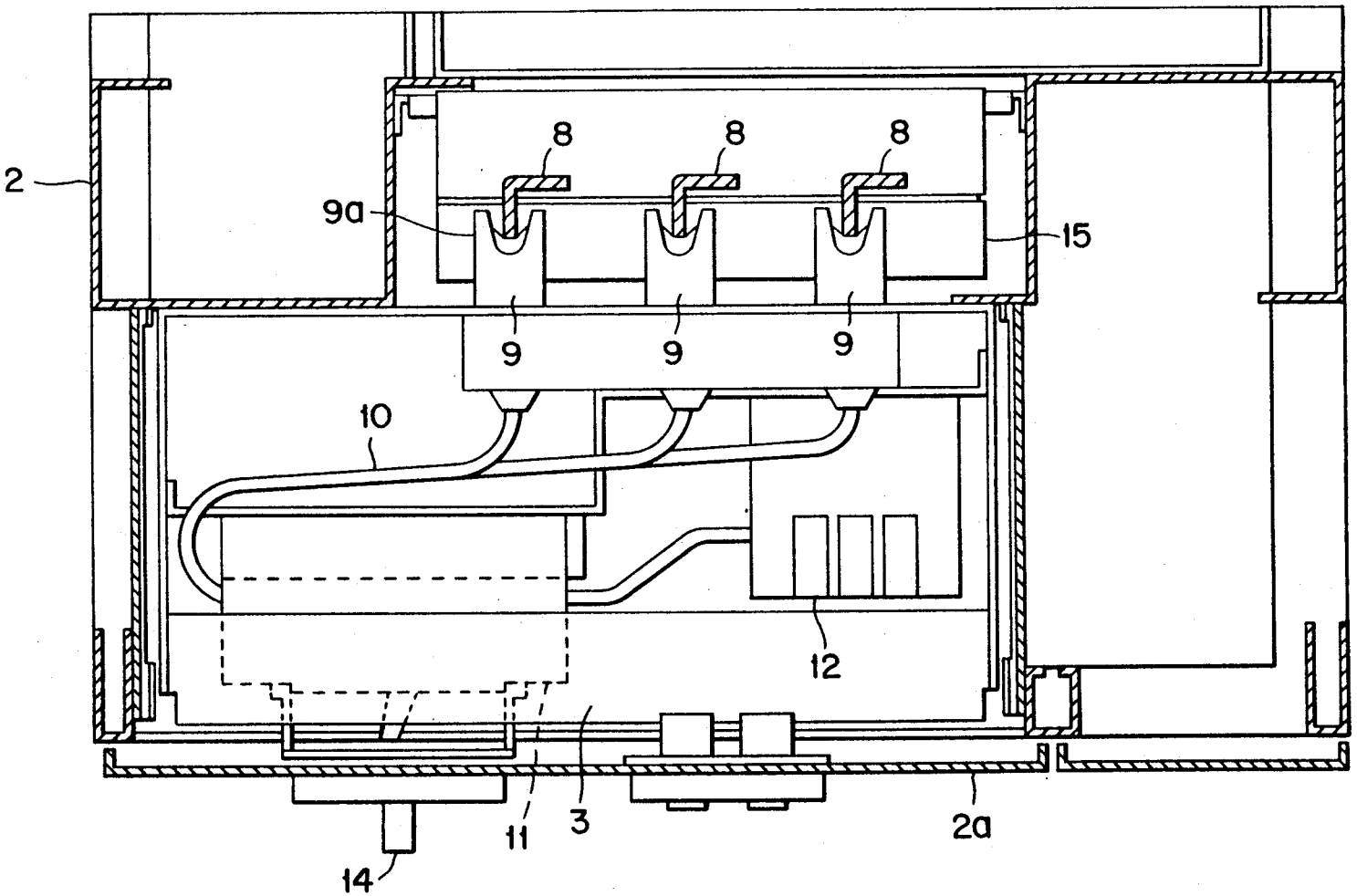
FIG. 15 (PRIOR ART)
FIG. 15 is the horizontal cross-sectional view showing a feeder unit 3 of the control center.
Figure 16:
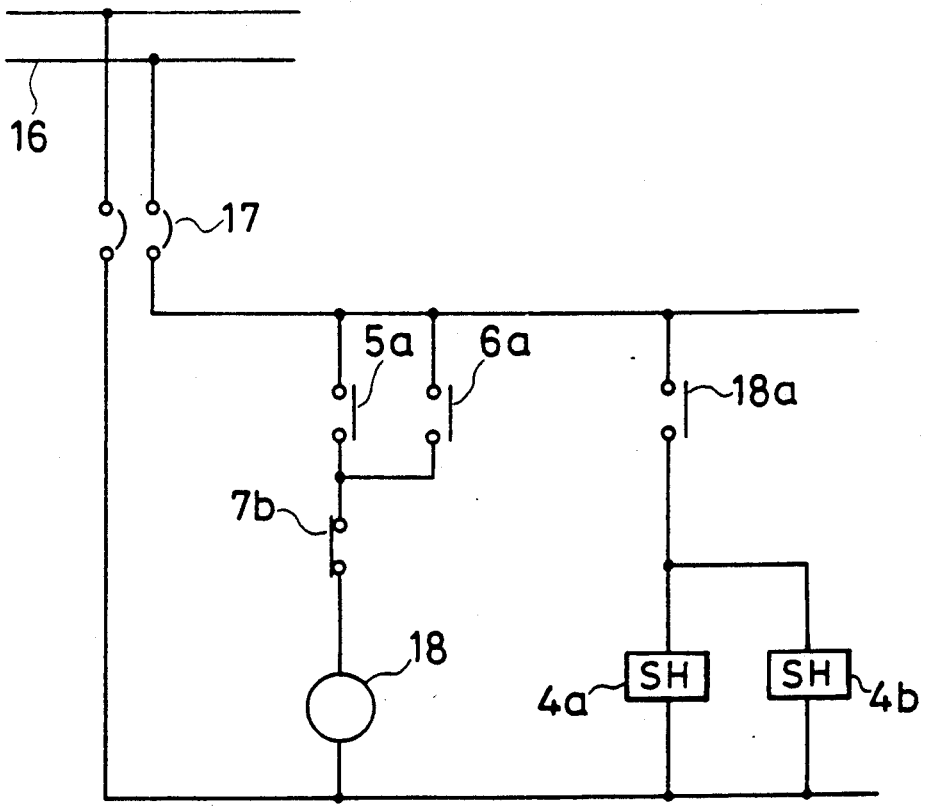
FIG.16 (Prior Art)
FIG. 16 is the conventional control circuit for space heaters.

FIG. 2 is a block skeleton diagram showing a main (power) circuit per one panel 2 of the control center 1 shown in FIG. 1. Construction of each of the feeder units 3 is the same as has been described as the prior art with reference to FIG. 15. In FIG. 15, three bus-bars 8 are vertically held by plural insulating supporters 15 (only one pair of them are visible) in the panel 2. In FIGS. 2 and 15, by inserting the feeder unit 3 into the panel 2, three connectors 9 of the feeder unit 3 are connected with three bus-bars 8, respectively, thereby being supplied with electric power from the bus-bars 8.

Each feeder unit 3 is composed of a circuit breaker 11, a magnetic contactor 12 and a thermal relay 13. The circuit breaker 11 is connected to the connectors 9 via main circuit conductors 10. The magnetic contactor 12 and the thermal relay 13, which are generally coupled with each other, are connected in series with the circuit breaker 11. In FIG. 15, the circuit breaker 11 can be operated by the operation handle 14 after the door 2a for the feeder unit 3 has been closed.

Figure 5:
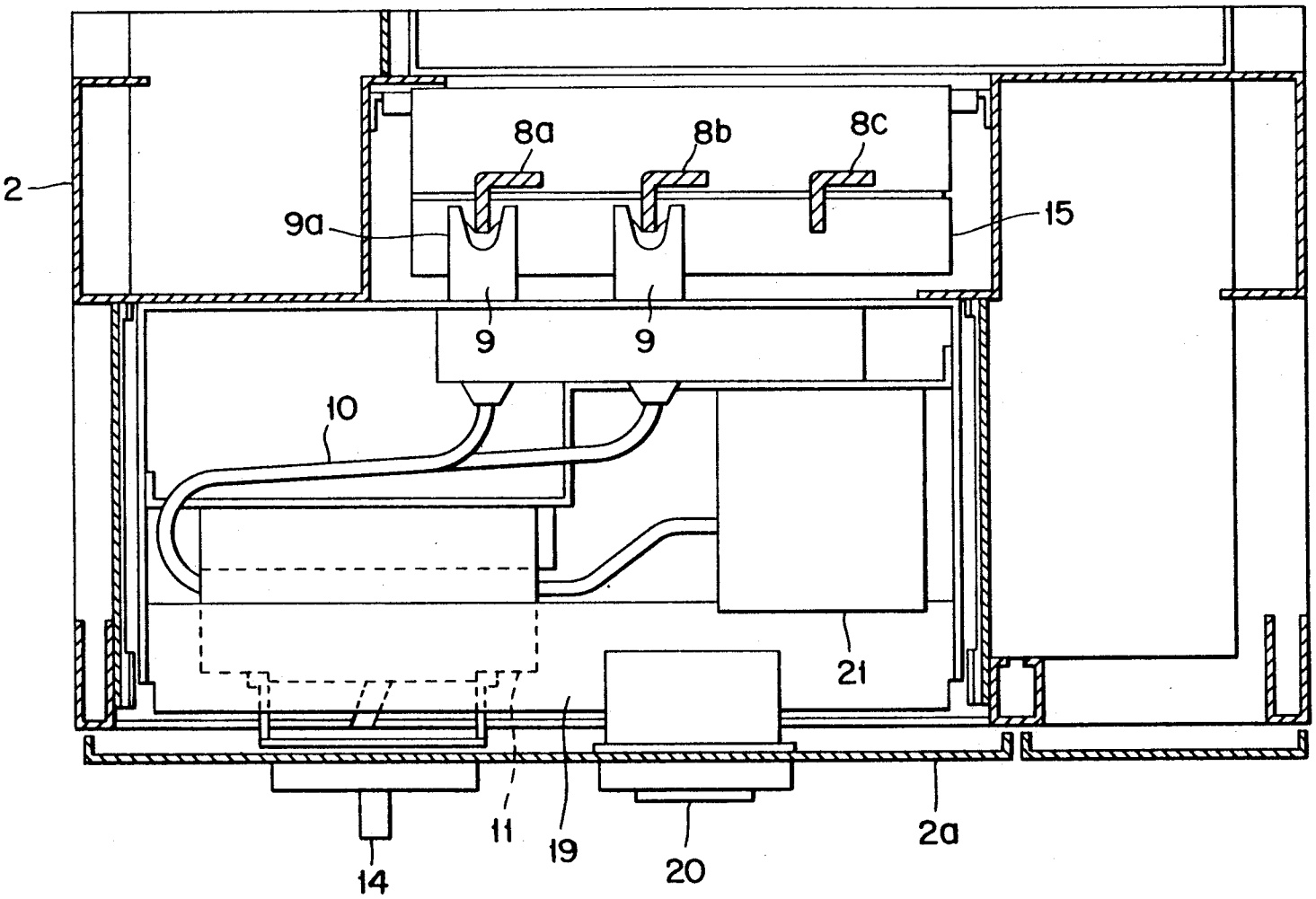
FIG. 5 is a horizontal cross-sectional view showing a leakage-current detecting unit 19 of FIGS. 1 and 2.

FIG. 5 is a horizontal cross-sectional view showing the leakage-current detecting unit 19 mounted in the panel 2. In FIG. 5, the bus-bars 8 (8a, 8b, 8c) are vertically held by plural insulating supporters 15 (only one pair of them are visible) in the panel 2. In FIG. 2 and 5, by inserting the leakage-current detecting unit 19 into the panel 2, two connectors 9 of the leakage-current detecting unit 19 are connected with the bus-bars 8a and 8b, respectively. The connectors 9 are thereby supplied with electric power from the bus-bars 8a and 8b. The leakage-current detecting unit 19 is mainly composed of the circuit breaker 11, a leakage-current detector 21 and a control circuit 20 formed into a unit. The circuit breaker 11 is connected to the connector 9 by way of main circuit conductors 10. The leakage-current detector 21 is connected in series with the circuit breaker 11. In FIG. 5, the circuit breaker 11 can be operated by the operation handle 14 after the door 2a for the leakage-current detecting unit 19 has been closed. The control circuit 20 is mounted in the door 2a.

Figure 4:
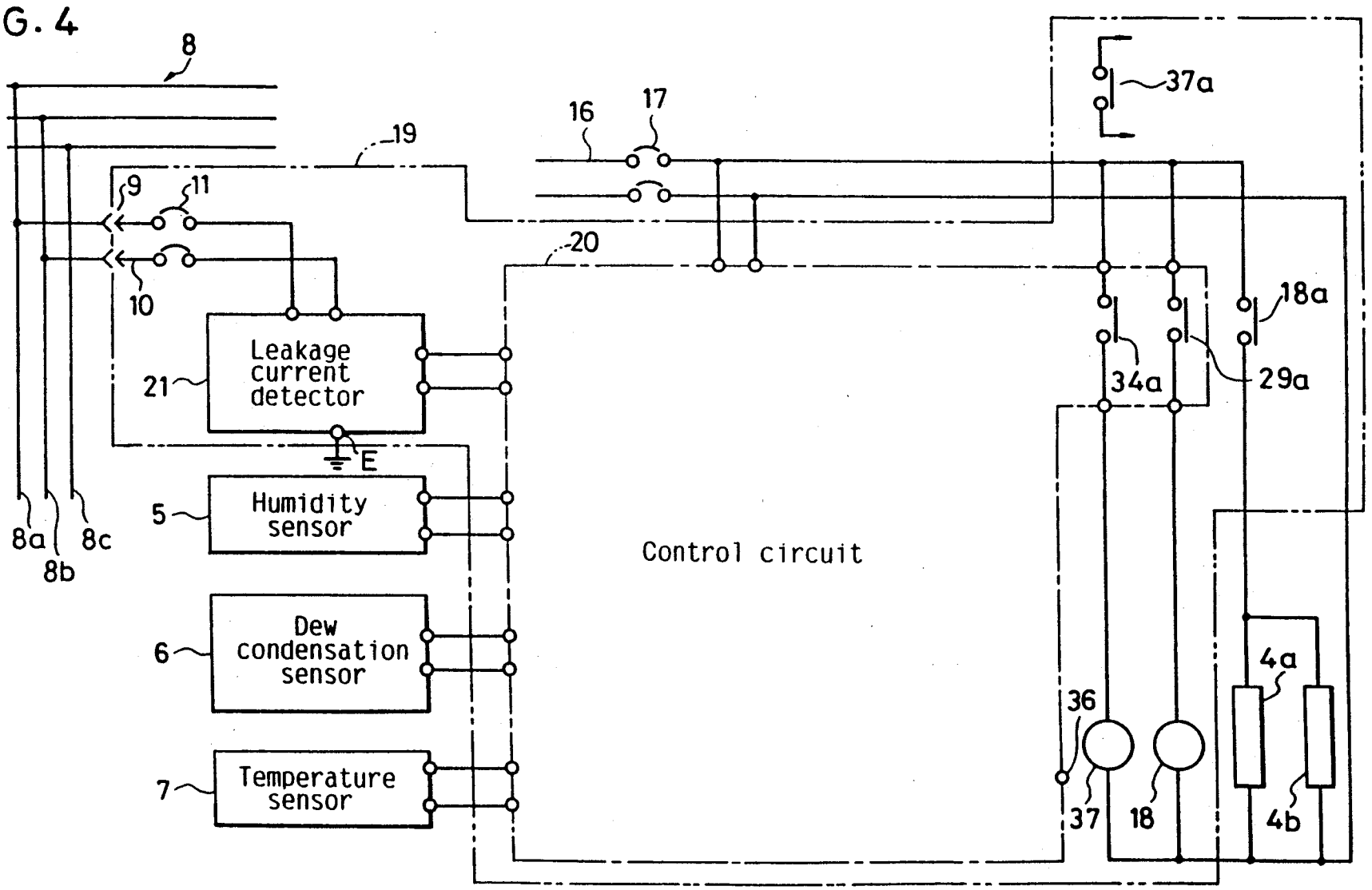
FIG. 4 is a circuit diagram showing a space heater circuit and the control circuit therefor in the present invention.

FIG. 4 is a circuit diagram showing mainly a space heater circuit for the space heaters 4a and 4b. In FIG. 4, electric power is supplied to the space heaters 4a and 4b from an auxiliary power line 16 via a circuit breaker 17. Power-supply to the space heaters 4a and 4b is controlled by a contact 18a of a control relay 18 which is mounted in the leakage-current detecting unit 19.

Figure 3:
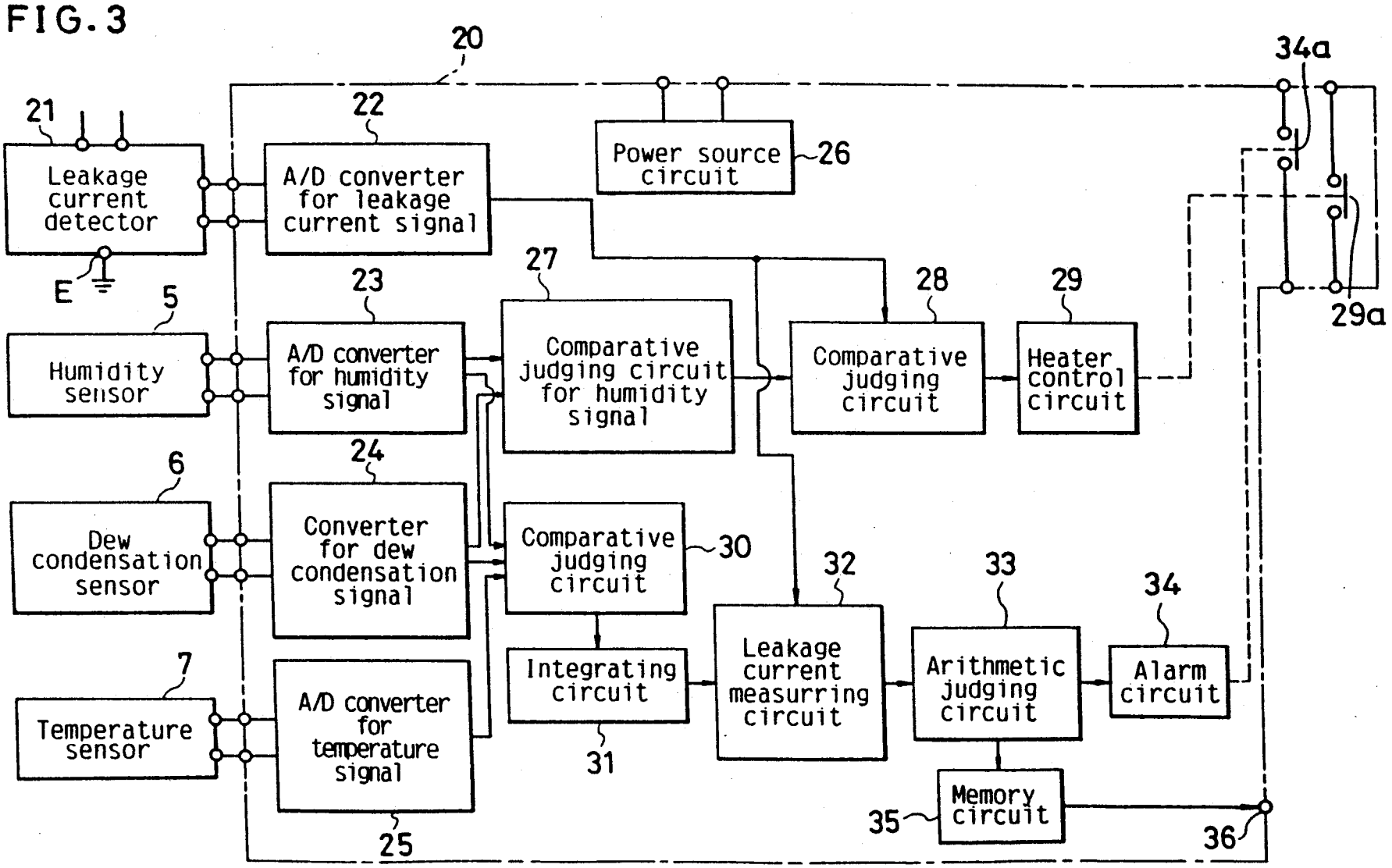
FIG. 3 is a block diagram showing a control circuit for space heaters in the present invention.

Next, an internal circuit of a control circuit 20, which is shown in FIG. 4, is described. FIG. 3 is a block diagram showing the internal circuit of the control circuit 20. In FIG. 3, an A/D converter 22 for leakage current signal is connected to output terminals of the leakage current detector 21, and an analogue output signal issued from the leakage current detector 21 is converted to a digital signal. Also, an A/D converter 23 for humidity signal and an A/D converter 25 for temperature signal are connected to output terminals of the humidity sensor 5 and the temperature sensor 7, respectively, and each analogue output signal is converted to a digital signal. A converter 24 for dew-condensation signal is connected to output terminals of the dew-condensation sensor 5, and an output signal is converted to a digital signal matching the next stage. A power source circuit 26 is connected to a secondary electric line of the circuit breaker 17 (FIG. 4). Following the A/D converter 23, a comparative judging circuit 27 for humidity signal, a comparative judging circuit 28 and a heater control circuit 29 are connected in this order. The comparative judging circuit 27, the comparative judging circuit 28 and the heater control circuit 29 constitute control means for controlling operation of the space heaters 4a and 4b. The comparative judging circuit 28 is also connected to the A/D converter 22. An output contact 29a of the heater control circuit 29 is connected in series to the control relay 18 (FIG. 4).

Following the converter 24 for dew condensation, a comparative judging circuit 30, an integrating circuit 31, a leakage-current measuring circuit 32, an arithmetic judging circuit 33 and an alarm circuit 34 are connected in this order. The arithmetic judging circuit 33 is also connected to a memory circuit 35 in which data of temperature, humidity and dew condensation are stored. The data stored in the memory circuit 35 can be issued to an output terminal 36. The alarm circuit 34 and the memory circuit 35 constitute indicating means for indicating an alarm about the insulating performance of the insulating materials. An output contact 34a of the alarm circuit 34 is used to excite a control relay 37 (FIG. 4). An output contact 37a (FIG. 4) of the control relay 37 serves as an alarm contact for an external circuit (not shown).

Hereafter, operation of the above-mentioned embodiment apparatus for preventing and predicting deterioration of insulation is described.

When the operation handle 14 is operated by an operator, the circuit breaker 11 is closed. In FIG. 4, when the circuit breaker 11 is closed, the leakage-current detector 21 is supplied with control power. The leakage-current detector 21 has a grounding terminal E by which an electric line of the bus-bar 8b is grounded by way of a resistor or a capacitor (not shown) provided in the leakage-current detector 21. The leakage current is thus always monitored by the leakage current detector 21. The auxiliary power line 16 is able to supply the load with electric power even when the main power applied to the bus-bar 8 is in interruption to service. When the circuit breaker 17 is closed, the control circuit 20 starts its operation.

In FIG. 3, a humidity signal, which has been digitized by the A/D converter 23, is inputted to the comparative judging circuit 27 and compared with reference humidity data. For example, this comparative judging circuit 27 issues an on-signal for the space heaters 4a and 4b when the humidity is equal to or more-than 85% and issues an off-signal for the space heaters 4a and 4b when the humidity is less than or equal to 65%. This on-signal or off-signal is inputted to the subsequent comparative judging circuit 28. The comparative judging circuit 28 judges whether the off signal is proper at the present time, taking the leakage current into consideration. For example, when the on-signal is issued from the comparative judging circuit 27, that is, when the present humidity is equal to or more than 85%, the comparative judging circuit 28 passes the on-signal to the heater control circuit 29. When the heater control circuit 29 receives the on-signal from the comparative judging circuit 28, the contact 29a is closed, thereby exciting the control relay 18 (FIG. 4). The contact 18a (FIG. 4) is thereby closed, and the space heaters 4a and 4b (FIG. 4) begin to generate heat. When the off-signal is issued from the comparative judging circuit 27, that is, when the present humidity is equal to or less than 65%, the comparative judging circuit 28 judges whether the off-signal should be issued or not, taking a gradient of variation of the leakage current into consideration. To be concrete, the comparative judging circuit 28 calculates a differential value of an effective value of the leakage current, and keeps the on-signal when the differential value is positive, and issues the off-signal when the differential value is negative.

When dew condensation is made in the panel 2, the dew-condensation sensor 6 detects it and issues a dew-condensation signal. This dew-condensation signal is converted to a digital signal by the converter 24, and the digital signal is inputted to the comparative judging circuit 27. The comparative judging circuit 27 executes the OR operation between the above-mentioned digital signal and the humidity signal of equal to or more than 85%, thereby to issue the on-signal. The heater control circuit 29 receives this on-signal by way of the comparative judging circuit 28 and turns on the space heaters 4a and 4b. When a temperature of air in the panel 2 rises, a relative humidity lowers in response thereto. As a result, the dew condensation vanishes, and occurrence of the dew condensation thereafter is prevented. Absorption of moisture in the insulating materials is thus prevented. When the dew-condensation sensor 6 no longer detects the dew condensation, the comparative judging circuit 28 issues the off-signal to the heater control circuit 29. The contact 29a is thereby opened to release the control relay 18 (FIG. 4), and the contact 18a (FIG. 4) is opened to turn off the space heaters 4a and 4b (FIG. 4).

Figure 6:
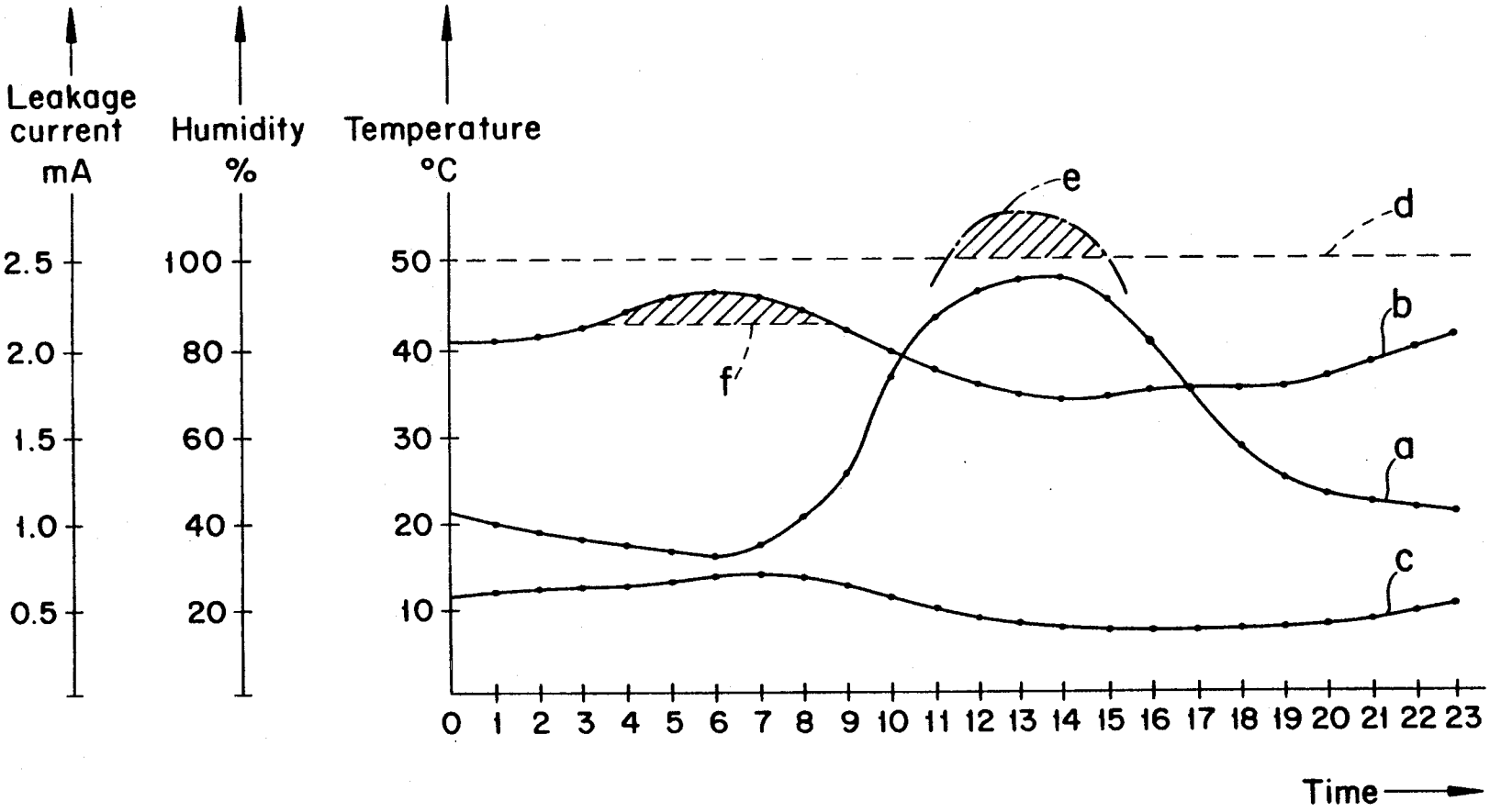
FIG. 6 is a graph showing temporal variations of leakage current, humidity and temperature in a panel 2 of the control center 1 shown in FIG. 1.

Next, the operation about the prediction of deterioration of insulation is described. FIG. 6 is a graph showing temporal variations of leakage current, humidity and temperature in a day. A curve "a" represents temperature of air in the panel 2 (FIG. 1), and a curve "b" represents humidity in the panel 2. A curve "c" represents leakage current detected by the leakage-current detector 21 (FIG. 4), and a dotted line "d" represents reference temperature (e.g., 50° C.) of air in the panel 2. A curve "e" represents an example at the time when the temperature "a" exceeds the reference temperature "d", and a dotted line "f" represents a reference humidity (e.g., 85%) in the panel 2.

In FIG. 3, the comparative judging circuit 30 receives digital data which are issued from the A/D converter 23, the converter 24 and the A/D converter 25. With respect to the humidity, for example, the reference humidity (i.e., 85%) is set in the comparative judging circuit 30 beforehand. In FIG. 6, when the humidity (b) exceeds the line "f", the integrating circuit 31 (FIG. 3) starts to execute the integration by time with respect to the value of the curve "b". This integration is continued during the time when the humidity (b) is above 85% as shown by a hatched part. When the integrated value reaches a predetermined value, the integrating circuit 31 (FIG. 3) issues a start signal for measuring leakage current to the leakage-current measuring circuit 32 (FIG. 3). After that, the integration circuit 31 resets the integrated value in preparation for the next exceeding over 85%. This procedure utilizing the integration is based on an assumption that the humidity exceeding the predetermined value may cause deterioration of insulation to the insulating materials as the time lapses.

In FIG. 3, upon receipt of the start signal for measuring leakage current from the integration circuit 31, the leakage-current measuring circuit 32 receives an output signal from the A/D converter 22, and calculates an effective value and its differential value as a first measured value and a second measured value, respectively. These first measured value and the second measured value are forwarded to the arithmetic judging circuit 33. The arithmetic judging circuit 33 compares the second measured value with a predetermined value. When the second measured value is equal to or more than the predetermined value, which means abnormally rapid increase of the leakage current, the arithmetic judging circuit 33 issues an output signal to the alarm circuit 34. The alarm circuit 34 receives this output signal and closes the output contact 34a to excite the control relay 37 (FIG. 4). By the excitation of the control relay 37, the alarm contact 37a (FIG. 4) is closed, thereby giving the external circuit (not shown) an alarm signal.

Figure 7:
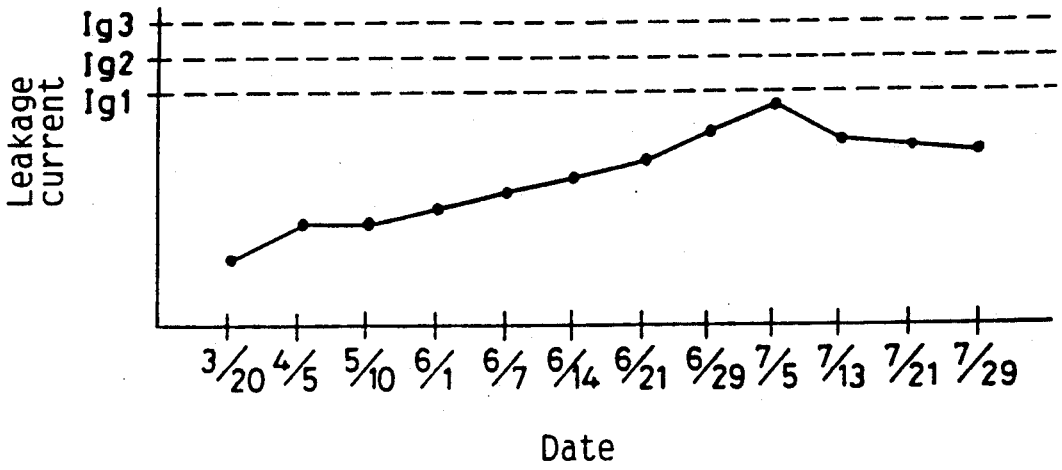
FIGS. 7–10 are graphs each showing a daily variation of the leakage current.

Further, the arithmetic judging circuit 33 forwards the first measured value to the memory circuit 35. The memory circuit 35 stores the first measured value therein one after another at every time when the first measured value is forwarded so that a trend of variation of leakage current can be stored. FIG. 7 is a graph showing an example of such trend of variation of leakage current. The abscissa represents the date of the measurement.

The arithmetic judging circuit 33 compares the first measured value with reference values Ig1, Ig2 and Ig3 shown in FIG. 7. When the first measured value is less than Ig1, the arithmetic judging circuit 33 judges that the insulating performance of the insulating materials is good. When the first measured value is equal to or more than Ig1, the arithmetic judging circuit 33 judges that the insulating performance of the insulating materials is neither very good nor too bad and is in a state necessitating an inspection. When the first measured value is equal to or more than Ig2, the arithmetic judging circuit 33 judges that the insulating performance of the insulating materials is so bad as to be informed as a prealarm state. When the first measured value is equal to or more than Ig3, a leakage-current protection relay (not shown) for the control center 1 (FIG. 1) makes a trip action. In accordance with the result of judgement, the arithmetic judging circuit 33 sends the memory circuit 35 specific data corresponding to messages of maintenance as mentioned later.

Figure 8:
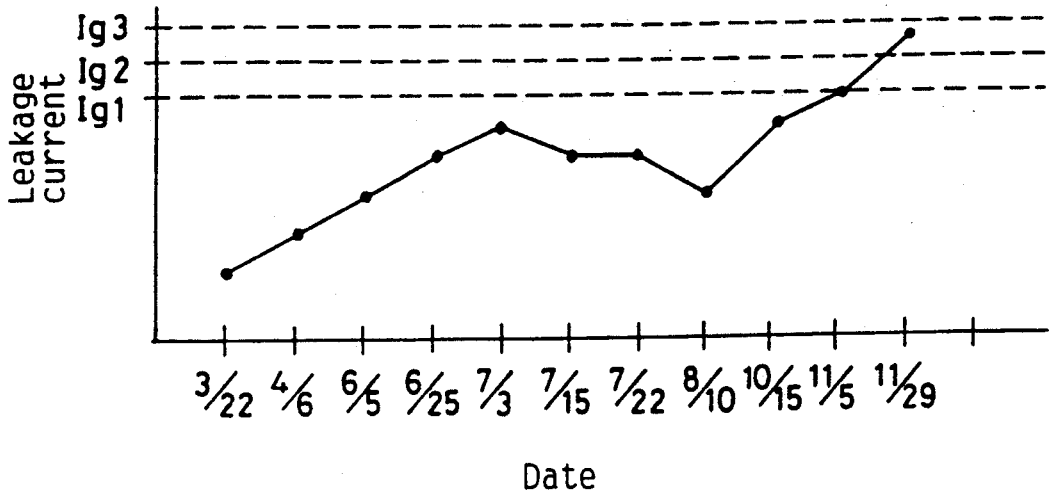

Next, measurement of variation of the leakage current is described with respect to the dew-condensation signal issued from the dew-condensation sensor 6. In FIG. 3, the integrating circuit 31 counts the number of generation of the dew-condensation signal which is issued at every time of occurrence of dew condensation. When a counted value reaches a predetermined number (e.g., five), the integrating circuit 31 issues a start signal for measuring leakage current to the leakage-current measuring circuit 32. After that, the integration circuit 31 resets the counted value in preparation for the next time of dew condensation. This procedure utilizing the number of occurrence of dew condensation is based on an assumption that the repeated dew condensation may cause deterioration of insulation to the insulating materials. The subsequent operation for issuing the alarm signal is carried out in the similar way to that based on the humidity signal. FIG. 8 is a graph showing variation of leakage current which is caused by the dew condensation. When the leakage current reaches Ig1 on Nov. 5, the arithmetic judging circuit 33 issues specific data indicating the necessity of inspection to the memory circuit 35. When the leakage current increase further and exceeds Ig2 on Nov. 29, the arithmetic judging circuit 33 issues specific data indicating the prealarm state to the memory circuit 35, These data are stored in the memory circuit 35 in the form of messages of maintenance.

Next, measurement of variation of the leakage current is described with respect to the temperature signal issued from the temperature sensor 7 (FIG. 3). In general, a reference temperature in the panel 2 (FIG. 1) is a value which is obtained by adding a temperature-rise of equipments in the panel 2 to the maximum ambient temperature 40° C. which is the standard of electrical equipments. It is considered appropriate that the temperature-rise of the equipments is 10K in view of each actual temperature of the electrical equipments, the insulating materials and the main circuit conductors. Therefore, the reference temperature (d) is 50° C. as shown in FIG. 6. When the space heaters 4a and 4b (FIG. 4) are operated as a result of increase of humidity or occurrence of the dew condensation, temperature in the panel 2 (FIG. 1) may exceed the reference temperature (d) as shown by the curve "e" in FIG. 6. The space heaters 4a and 4b (FIG. 4) are generally controlled so that the temperature-rise of air in the panel 2 (FIG. 1) is made 5K. When a current flowing through the electrical equipments is small, heat generation by the space heaters 4a and 4b is helpful for decreasing humidity. However, when a current flowing through the electrical equipments is very large, temperature of air rises by heat generation of the electrical equipments even though no space heaters are operated. When the temperature exceeds the reference temperature (d), the insulating materials get an undesirable effect that may shorten their lifetimes on the contrary.

Figure 9:
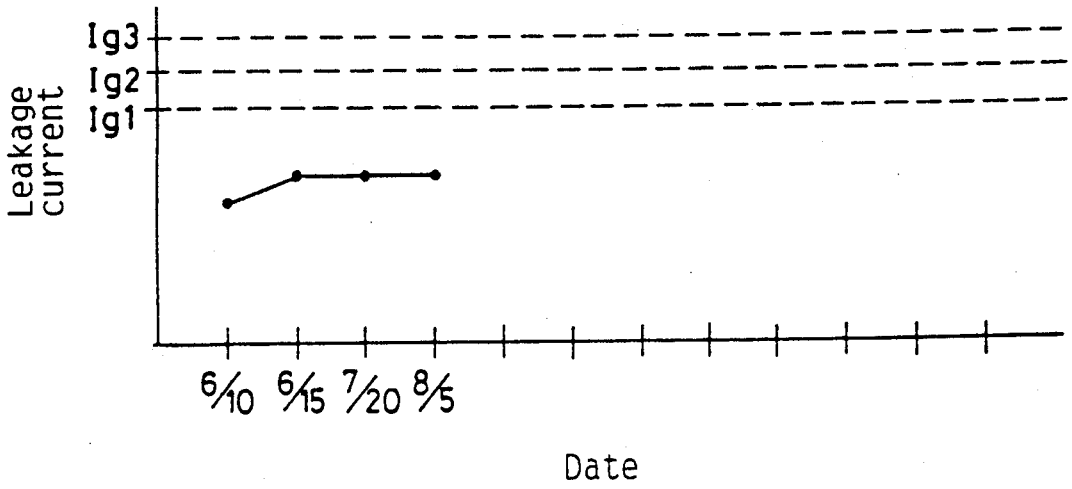

Considering the above-mentioned fact, monitoring of the excessive temperature is necessary for the prediction of deterioration of insulation as well as humidity and dew condensation. Therefore, when the temperature exceeds the reference temperature (d), the integrating circuit 31 (FIG. 3) executes the integration by time with respect to a value of the curve "e". This integration is continued during the time when the temperature (e) is above 50° C. as shown by a hatched part in FIG. 6. When the integrated value reaches a predetermined value (e.g., an integrated value equivalent to that a predetermined temperature above 50° C. is continued for 120 hours), the integrating circuit 31 (FIG. 3) issues a start signal for measuring leakage current to the leakage-current measuring circuit 32 (FIG. 3). After that, the integration circuit 31 resets the integrated value in preparation for the next exceeding over 50° C. The subsequent operation for issuing the alarm signal is carried out in the similar way to that based on the humidity signal. FIG. 9 is a graph showing variation of leakage current which is caused by the excessive temperature.

Figure 10:
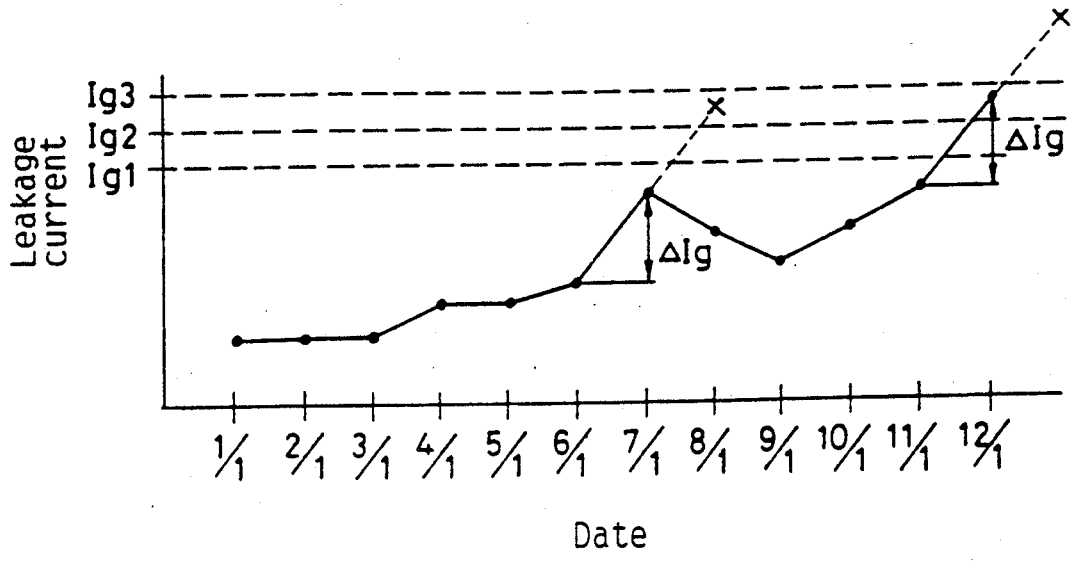

Next, a periodical measurement of leakage current is described. In addition to the measurement started from the outputs of the sensors 5, 6 and 7 (FIG. 1), the periodical measurement of leakage current is carried out. For example, the leakage current measuring circuit 32 automatically measures the leakage current once a month and sends a measured value to the arithmetic judging circuit 33. Since this measured value is influenced by the weather and the season (i.e., temperature and humidity), it is not always preferable to honestly adopt the value as an impartial value. Therefore, the measured value is converted by the arithmetic judging circuit 33 to a compensated value based on a mean value of humidity in a year. Also, the measured value is converted to a compensated value based on a mean value of temperature in a year. Each of these compensated values is stored monthly in the memory circuit 35, thereby to form a trend data. FIG. 10 is a graph showing monthly variation of leakage current. The leakage current is measured once (the first day) a month. By comparing a value measured at the present month (e.g., 7/1) with a value measured at the last month (i.e., 6/1), a difference $\Delta Ig$ is obtained. When this difference is larger than a predetermined value, the arithmetic judging circuit 33 forms a judgement that inspection of the insulating materials is necessary, and issues data indicating this judgement. The data are stored in the memory circuit 35. Further, in view of a present gradient given by the difference $\Delta Ig$ on the present data Jul. 1, the arithmetic judging circuit 33 predict that the leakage current will increase up to a point of "x" on Aug. 1. Therefore, the arithmetic judging circuit 33 issues the data which indicate this prediction and store necessary related data in the memory circuit 35. When the leakage current exceeds Ig2 on Dec. 1, the arithmetic judging circuit 33 issues the data indicating the prealarm state. Furthermore, since it can be expected at the present time that the leakage current will exceed Ig3 on the next date (Jan. 1), the arithmetic judging circuit 33 issues the data indicating the necessity of emergency inspection. These data are stored in the memory circuit 35.

In FIG. 3, by connecting a data reading unit (not shown) with the output terminal 36 of the memory circuit 35, the data stored in the memory circuit 35 can be periodically taken out. It is also possible to connect a computer (not shown) by way of a data transmitter (not shown) with the output terminal 36 so that the data can be always monitored at the real time.

Figure 11:
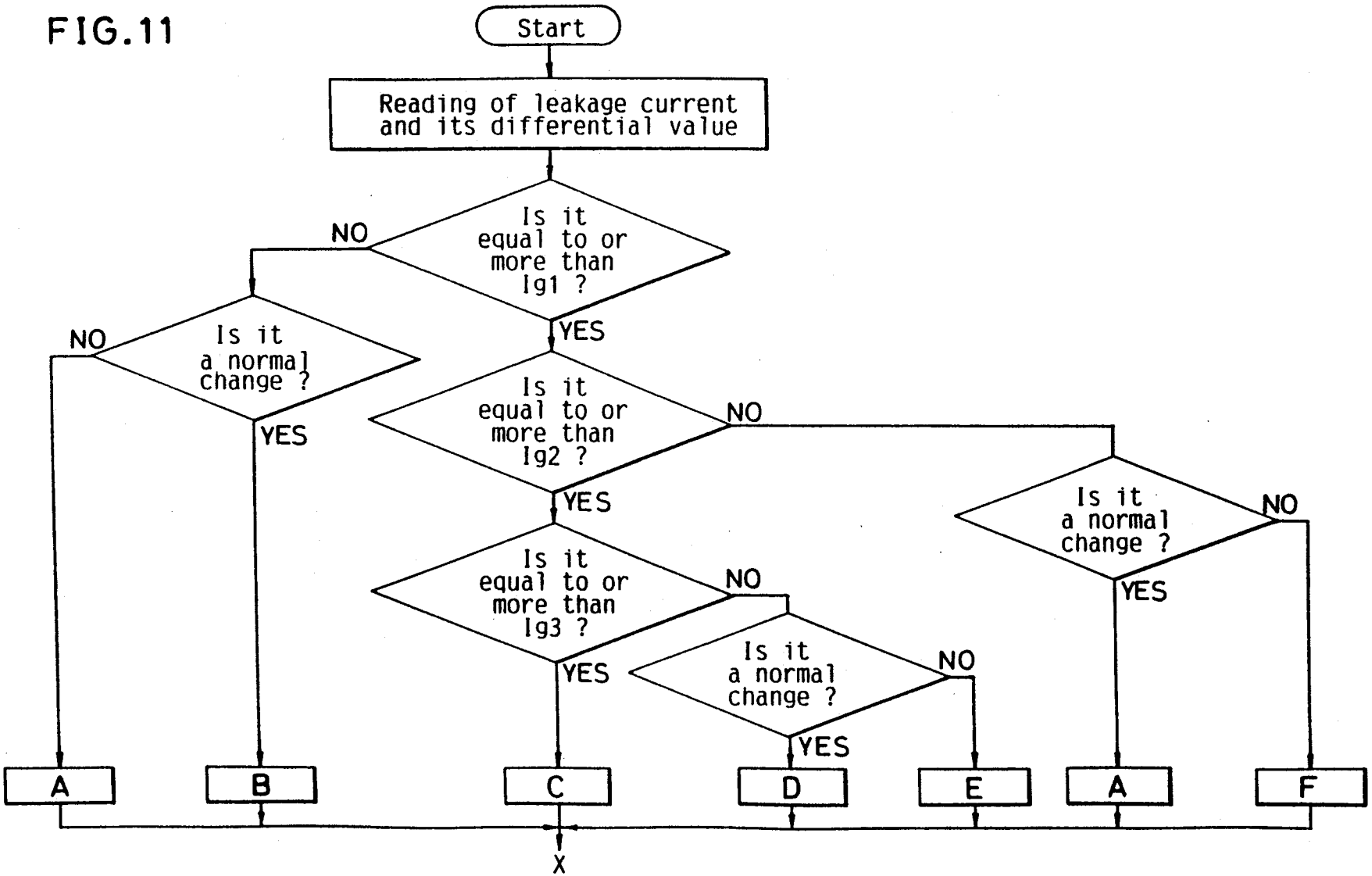
FIG. 11 is the first half of a flow chart executed in the control circuit 20 shown in FIG. 3.
Figure 12:
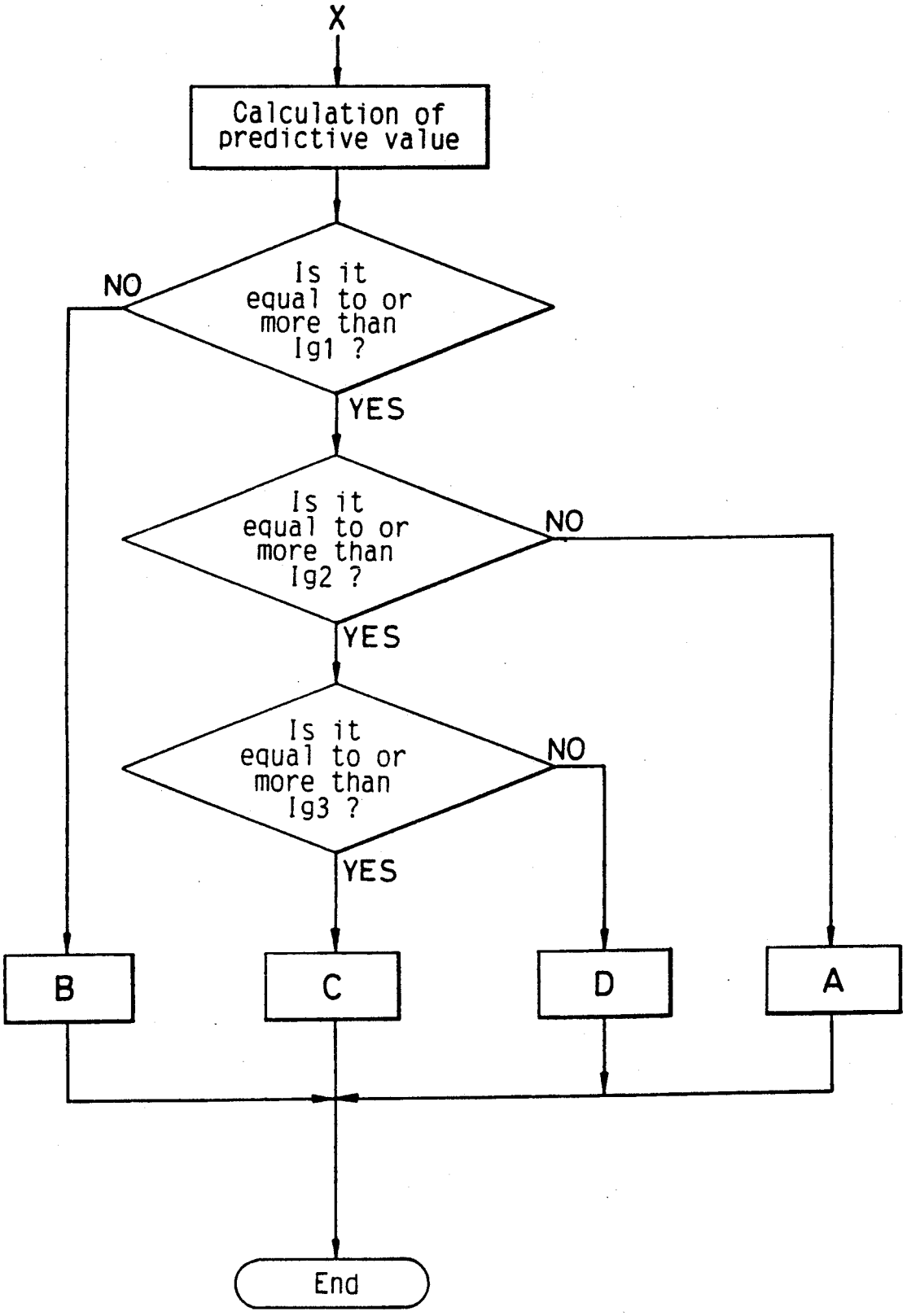
FIG. 12 is the latter half of the flow chart.
Figure 13:
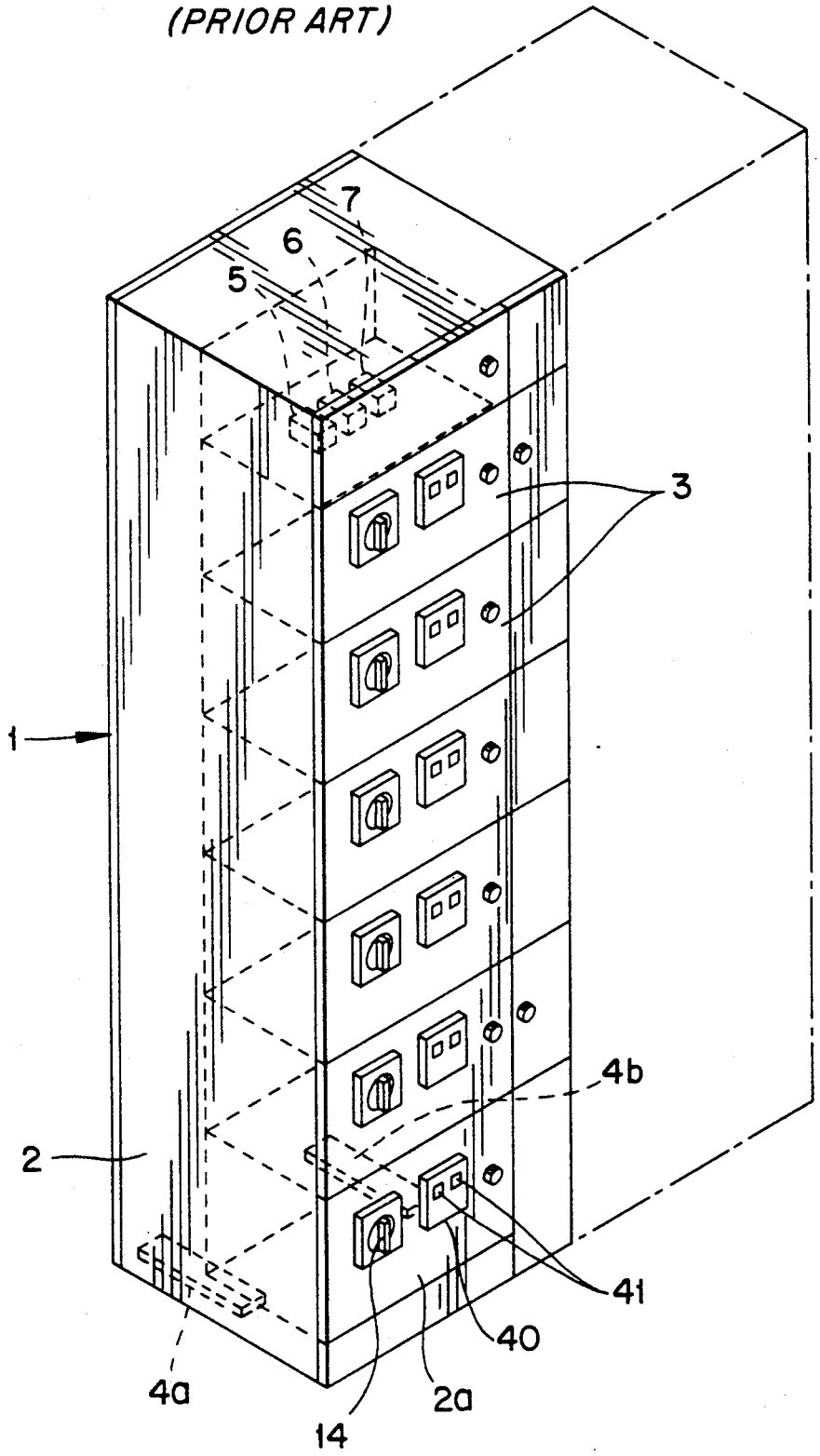
FIG. 13 (PRIOR ART)
FIG. 13 is the perspective view showing the control center including the conventional apparatus for preventing deterioration of insulation.
Figure 14:
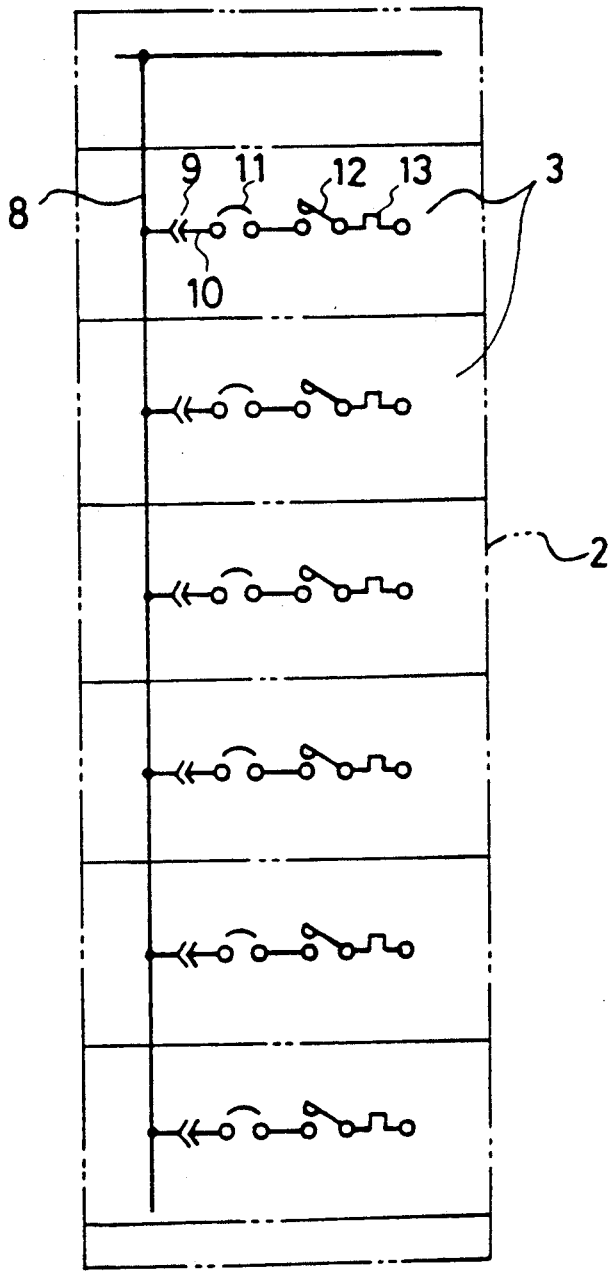
FIG. 14 (Prior Art)
FIG. 14 is the block skeleton diagram showing the conventional control center.

FIG. 11 and FIG. 12 are upper and lower parts of a flow chart and should be combined with each other for reading. The flow chart shows procedures for making messages of maintenance in accordance with the measured value of leakage current. In these figures, steps shown by letters A–F mean that the data indicating the following messages of maintenance are issued to the memory circuit 35 (FIG. 3), respectively:

A . . . "Inspect the insulating materials by appearances and measure the insulating resistance.", B . . . "Insulating materials are healthy.", C . . . "Deterioration of insulation is detected. Careful inspection is emergently required to find and cure a faulty insulating material.", D . . . "Careful inspection will be required in the near future.", E . . . "Careful inspection is emergently required. Exchange a faulty insulating material for new one. After cleaning the insulating materials, make sure that the insulating resistance is normal.", F . . . "Inspect the insulating materials by appearances emergently and clean them. After cleaning, make sure that the insulating resistance is normal.".

Although the above-mentioned apparatus for preventing and predicting deterioration of insulation is applied to the control center, the apparatus may be applied to another switchboard in which space heaters are used.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An apparatus for preventing and predicting deterioration of electrical insulation in electrical equipment, comprising:

a leakage current detector for detecting a leakage current flowing though insulating materials in said electrical equipment;

a sensor for detecting humidity in said electrical equipment;

a space heater mounted in said electrical equipment;

control means for controlling operation of said space heater in response to a first output signal based on said sensor and a differentiated value of an effective value of a second output signal based on said leakage current detector;

leakage-current measuring means which receives said second output signal and issues the effective value of said second output signal and the differentiated value of said effective value;

arithmetic judging means for issuing an output signal based on a result which is obtained by comparing said effective value and said differentiated value with respective predetermined values; and indicating means for indicating a state of insulating performance of said insulating materials in response to said output signal of said arithmetic judging means.

2. An apparatus for preventing deterioration of electrical insulation in electrical equipment, comprising:

a leakage current detector for detecting a leakage current flowing through insulating materials in said electrical equipment;

a humidity sensor for detecting humidity in said electrical equipment;

a dew condensation sensor for detecting dew condensation in said electrical equipment;

a space heater mounted in said electrical equipment;

a first comparative judging circuit for selectively issuing a control signal for said space heater in response to output signals of said humidity sensor and said dew condensation sensor;

a second comparative judging circuit for selectively passing said control signal in response to a differentiated value of an effective value of leakage current detected by said leakage current detector; and a heater control circuit for controlling said space heater in response to said control signal.

3. An apparatus for predicting deterioration electrical insulation in electrical equipment, comprising:

a leakage current detector for detecting a leakage current flowing through insulating materials in said electrical equipment;

a humidity sensor for detecting humidity in said electrical equipment;

a dew condensation sensor for detecting dew condensation in said electrical equipment;

a temperature sensor for detecting temperature in said electrical equipment;

first judging means which issues a signal for measuring a leakage current when at least one of humidity, dew condensation and temperature satisfies a predetermined condition with respect to a predetermined period or predetermined times;

leakage-current measuring circuit which measures a leakage current detected by said leakage current detector at every time of receipt of said signal and issues an effective value of said leakage current and a differentiated value of said effective value;

second judging means which issues an output signal when said differentiated value is equal to or more than a predetermined value and which issues said effective value;

alarm circuit for indicating a state of alarm when said output signal is received; and a memory circuit for storing said effective value at every time when said effective value is issued from said second judging circuit.

* * * * *